United States Patent [19]

Friedlander

[11] Patent Number: 4,764,710

[45] Date of Patent: Aug. 16, 1988

[54] HIGH-EFFICIENCY BROAD-BAND KLYSTRON

[75] Inventor: Fred I. Friedlander, Saratoga, Calif.

[73] Assignee: Varian Associates, Inc., Palo Alto, Calif.

[21] Appl. No.: 932,806

[22] Filed: Nov. 19, 1986

[51] Int. Cl.[4] ..... H01J 25/10

[52] U.S. Cl. ..... 315/5.43; 315/5.39; 315/5.51

[58] Field of Search ..... 315/5.51, 5.43, 5.39, 315/5.46, 5.49, 5.52

[56] References Cited

U.S. PATENT DOCUMENTS

| | | | |
|---|---|---|---|
| 2,605,444 | 7/1952 | Garbuny | 315/5.43 |
| 3,195,007 | 7/1965 | Watson | 315/5.43 |
| 3,622,834 | 11/1971 | Lien | 315/5.39 |
| 3,819,977 | 6/1974 | Kageyama | 315/5.43 |
| 3,902,098 | 8/1975 | Tanaka et al. | 315/5.39 |
| 3,942,066 | 3/1976 | Kageyama et al. | 315/5.43 |
| 4,284,922 | 8/1981 | Perring et al. | 315/5.43 |
| 4,558,258 | 12/1985 | Miyake | 315/5.43 |

*Primary Examiner*—Saxfield Chatmon

*Attorney, Agent, or Firm*—Stanley Z. Cole; Gerald M. Fisher; Peter J. Sgarbossa

[57] ABSTRACT

In a multi-cavity klystron amplifier tube, the gain-bandwidth product is improved and the amplitude response is made flatter by successive intermediate floating cavities downstream of the input cavity tuned to successively higher frequencies, and the drift lengths between them successively shorter.

6 Claims, 1 Drawing Sheet

HIGH-EFFICIENCY BROAD-BAND KLYSTRON

FIELD OF THE INVENTION

The invention pertains to multi-cavity klystron amplifier tubes such as used in high-power microwave transmitters for radar and communications where an appreciable band of frequencies must be amplified uniformly.

PRIOR ART

It is know that the efficiency of a klystron amplifier tube can be improved by providing a "floating" cavity (no external wave connections) upstream of the output cavity. This penultimate cavity is at a critical, rather short distance upstream of the output and is tuned to a resonant frequency higher than the operating frequency so that its impedance is inductive. In that way, the beam bunching produced by the penultimate cavity is in phase with the already existing bunching entering it.

To increase the gain, it is customary to add other floating cavities between the input and penultimate cavities. For maximum gain, these have been tuned to the signal frequency. However, they sharply reduce the overall frequency bandwidth, by a combination of effects. First, there is the cumulative sharpening due to a sequence of circuits tuned "synchronously" to the same frequency, as in any simple multi-stage amplifier.

When increased bandwidth is needed, the prior art approach was to add more floating cavities and stagger their resonance frequencies. This is analogous to bandpass filters and conventional amplifiers, for which design procedures are well known. However, a klystron is not like a coupled-cavity filter, or an intermediate-frequency amplifier with only sequential coupling between circuits. In a klystron there is a forward-only coupling by the electron stream from each cavity to all other cavities downstream from it. This makes the overall response characteristic very complicated, and its mathematical calculation is best done by computer simulation. A simplified concept is to consider just three cavities: relatively broadband externally loaded input and output cavities tuned to the same frequency and a single, unloaded intermediate cavity tuned inside their passband. As described above under efficiency, for a transmitted frequency below the resonance of the intermediate cavity, the velocity modulation produced by it is in phase with the modulation entering it so the gain is enhanced. However, for a frequency above its resonance, the intermediate cavity appears capacitive and the modulation produced by it tends to cancel the fed-thru modulation from the input. As the frequency increases the capacitive impedance of the floating cavity decreases so its internally produced modulation decreases. For a certain frequency it becomes equal and opposite to the fed-thru modulation and a zero point in gain is reached.

The cumulative result of these kinds of effects is to make the response of a multi-cavity stagger-tuned klystron very complex.

Many empirical and quasi-theoretical tuning programs have been devised. These involve choices of resonant frequencies, cavity Q's and intercavity drift lengths. A few examples will suffice.

U.S. Pat. No. 3,210,593 issued Oct. 5, 1965 to C. E. Blinn and G. Caryotakis describes a choice of resonant frequencies and cavity Q's.

U.S. Pat. No. 3,429,794 issued May 3, 1966 to A. Staprans and G. Caryotakis describes tuning the floating driver cavities to progressively higher frequencies, with Q's decreasing and then rising.

In most of this prior art, no attention was given to the drift lengths between cavities. From simple klystron theory it was known that the greatest gain per stage required the space-charge wavelength between cavities be approaching one-quarter wave. To minimize overall tube lengths the drift spaces were somtimes made somewhat shorter, but their effect on bandpass characteristics was seldom considered an important design characteristic.

A recent development in klystron gain-bandwidth was described by Robert S. Symons at the May 1986 Microwave Power Tube Conference sponsored by the Institute of Electrical and Electronic Engineers. As described in the published abstract and the notes published in the June 1986 issue of Microwave Journal, V. 29, No. 6, page 32, the improvement was to use a pair of intermediate cavities tuned to the same frequency and spaced very closely together along the beam. The main effect was to obliterate one of the zeros without lengthening the over-all tube structure. A disadvantage of Symons' tube is that to get the two cavity gaps very close together along the beam can entail locating the gaps off-center in the adjacent cavities. This lowers the inherent characteristic impedance (R/Q) of the cavities, thus raising the operating Q for a desired interaction impedance. The result is to make the frequency response less flat and also more sensitive to manufactureing tolerances and environmental conditions.

SUMMARY OF THE INVENTION

An object of the invention is to provide a klystron amplifier with an improved gain-bandwidth product.

A further object is to provide an amplifier of reduced length.

A still further object is to provide a broadband amplifier with improved flatness response over its passband.

These objects are realized by a combination of two progressive modifications along the sequence of floating-cavity intermediate amplifier stages. In general, successive cavities are tuned to successively higher resonant frequencies. Also, the intervening drift spaces are made successively shorter.

DESCRIPTION OF THE PREFERRED EMBODIMENTS

Figure 1:
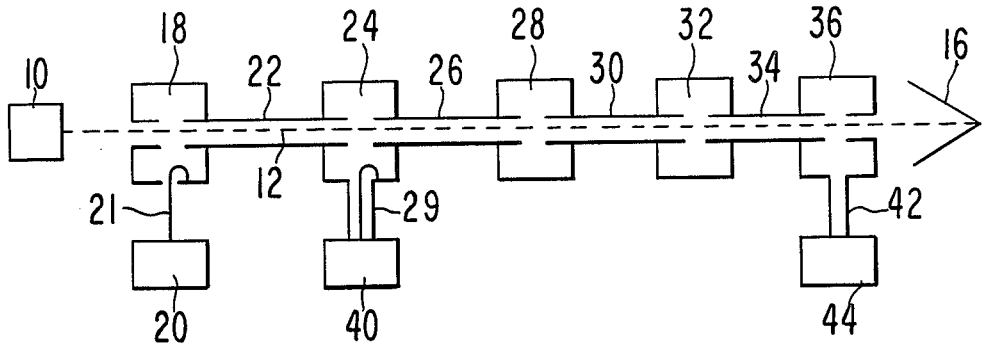
FIG. 1 is a schematic diagram of a klystron embodying the invention.

The essence of the invention is the concept that improved gain-bandwidth can be obtained by tuning the floating cavities to successively higher frequencies while successively decreasing the drift lengths between them. It is recognized that the tuning program can be applied to conventionally constructed tubes. However, to obtain optimum performance the tube must additionally incorporate construction features as illustrated by FIG. 1.

The klystron comprises an electron gun 10 (shown functionally) for injecting a linear electron beam 12 thru a succession of interaction cavities 18, 24, 28, 32, 36 into a final collector 16.

The first cavity 18 is driven by an external signal generator 20 via a transmission line 21 to impress the input signal on beam 21. After passage thru input cavity 18 beam 12 travels down a first drift tube 22 to a second cavity 24, thence thru a succession of drift tubes 26, 30, 34 of generally decreasing lengths between successive cavities 28, 32, 36. Cavities 24, 28, 32 are called "floating" cavities because they have no coupling to external wave-interaction circuits. However, one such as 24 or more may be coupled to an external dissipative load 40 via a transmission line 29 to decrease its Q and hence increase the inherent bandwidth. The final, or "output" cavity 36 is coupled via transmission line 42, such as a hollow waveguide, to the useful microwave load 44, such as an antenna.

In the preferred embodiment, output cavity 36 is tuned to the center of the operating frequency band. Input cavity 18 may be tuned near the lower edge of the band or, in some embodiments, to a frequency at or near the center. Floating cavities 24, 28, 32 are preferably tuned to frequencies successively higher than input cavity 18 or subsequent cavity 24, whichever is tuned lowest. However, for special applications, one or more may be tuned outside this sequence.

Figure 2:
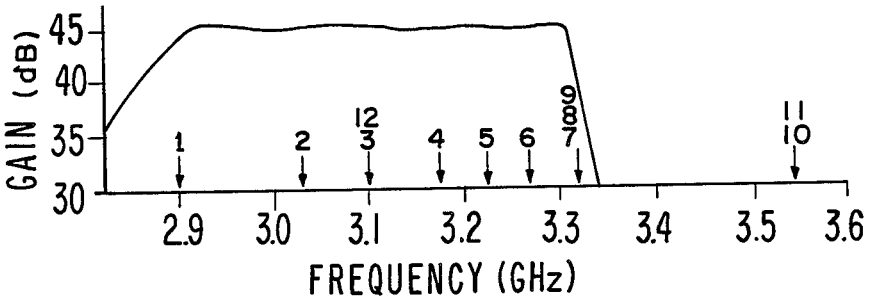
FIG. 2 is a sketch of a typical response of the tube of FIG. 1.
Figure 3:
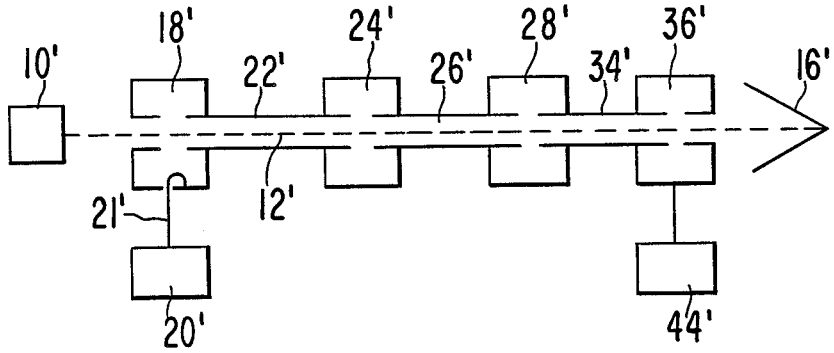

FIG. 2 is a calculated graph of the gain vs. frequency of a 12-cavity klystron embodying the invention. The resonant frequencies of the sequence of cavities 1–12 are indicated on the abscissa. A direct comparison of the result with the prior art is not meaningful because the prior art is so diversified.

Another advantage of the invention is that the improved gain-bandwidth may be obtained in an overall tube length at most no longer than prior-art schemes.

It will be obvious to those skilled in the art that variations in the embodiments may be made within the true scope of the invention. The invention is to be limited only by the following claims and their legal equivalents.

I claim:

1. A klystron amplifier tube with a beam-interaction structure comprising:

an input cavity adapted to couple to an external signal source, an output cavity adapted to couple to an external load, and a number of floating cavities between said input and output cavities, the improvement wherein, a consecutive sequence of at least three of said floating cavities having progressively higher resonant frequencies, and interaction gaps separated from the interaction gap of the immediately preceding cavity by progressively shorter drift spaces.

2. The klystron of claim 1 wherein said drift spaces are generally occupied by conductive drift tubes surrounding the electron beam and having negligible electromagnetic interaction therewith.

3. The klystron of claim 1 wherein said sequence contains at least four cavities.

4. The tube of claim 1 wherein at least one of said floating cavities is coupled to a dissipative load.

5. The tube of claim 4 wherein said dissipative load is external to said cavity.

6. The tube of claim 5 wherein said coupling is by a propagative transmission line.

* * * * *